US009053682B2

(12) United States Patent
Morong

(10) Patent No.: US 9,053,682 B2
(45) Date of Patent: Jun. 9, 2015

(54) STOP ACTION-MAGNETS TO REDUCE MUSICAL INSTRUMENT WIRING, CONNECTIONS, AND LOGIC

(71) Applicant: William Henry Morong, Paoli, PA (US)

(72) Inventor: William Henry Morong, Paoli, PA (US)

( * ) Notice: Subject to any disclaimer, the term of this patent is extended or adjusted under 35 U.S.C. 154(b) by 17 days.

(21) Appl. No.: 14/078,732

(22) Filed: Nov. 13, 2013

(65) Prior Publication Data

US 2015/0128785 A1 May 14, 2015

Related U.S. Application Data

(63) Continuation of application No. 13/570,664, filed on Aug. 9, 2012, now Pat. No. 8,609,971.

(51) Int. Cl.
*G10B 3/10* (2006.01)

(52) U.S. Cl.
CPC ..... *G10B 3/10* (2013.01)

(58) Field of Classification Search
CPC ..... G10B 3/10
See application file for complete search history.

(56) References Cited

U.S. PATENT DOCUMENTS

| | | | | | |
|---|---|---|---|---|---|
| 3,213,179 | A * | 10/1965 | Clauson | 84/724 |
| 3,498,168 | A * | 3/1970 | Cunningham | 84/345 |
| 3,548,064 | A * | 12/1970 | Oncley | 84/343 |
| 3,612,882 | A * | 10/1971 | Sheppard | 250/208.4 |
| 3,686,994 | A * | 8/1972 | Badessa | 84/345 |
| 3,926,087 | A * | 12/1975 | Griffis | 84/345 |
| 7,777,116 | B2 * | 8/2010 | Luciani | 84/456 |
| 8,609,971 | B2 * | 12/2013 | Morong | 84/725 |
| 2012/0055320 | A1 * | 3/2012 | Morong | 84/746 |
| 2013/0042743 | A1 * | 2/2013 | Morong | 84/339 |
| 2015/0071451 | A1 * | 3/2015 | Moon | 381/62 |

* cited by examiner

*Primary Examiner* — Robert W Horn

(57) ABSTRACT

The present invention provides, for musical instruments such as organs, action-magnets and action-magnet drivers that facilitate reduction of wiring, connections, and logic circuitry. Some embodiments of present invention provide stop action-magnets, also called SAM's, comprising integral drive circuitry and, which may further comprise additional integral circuitry. Embodiments of this invention may comprise, logic circuits such as a shift-register cells, micro-controllers, or both. Some embodiments of this invention comprise shift-cells and registers combining both SIPO and PISO functions for addressing SAM's. A single-coil SAM embodiment of the present invention may respond to signals intended to operate traditional two-coil SAM's. In another embodiment, a pipe action-magnet driver comprises logic circuitry. In yet another embodiment a pipe action-magnet comprises an integral driver that further comprises logic circuitry.

9 Claims, 12 Drawing Sheets

3
8
7
9
6
41
40
4
5
7
10M
300
6
41

42
40
40
350
300
10M
600

10M
201
30
8
300
600
601
601
71
11

STOP ACTION-MAGNETS TO REDUCE MUSICAL INSTRUMENT WIRING, CONNECTIONS, AND LOGIC

CROSS-REFERENCE TO RELATED APPLICATIONS

This application is a continuation of application Ser. No. 13/570,664, filed Aug. 9, 2012, now pending. The patent application identified above is incorporated here by reference in its entirety to provide continuity of disclosure.

This application claims the benefit of U.S. Provisional Application 61/525,758 filed Aug. 20, 2011.

STATEMENT REGARDING FEDERALLY SPONSORED RESEARCH OR DEVELOPMENT

The present invention was not developed with the use of any Federal Funds, but was developed independently by the inventor.

BACKGROUND OF THE INVENTION

Musical instruments, particularly organs, may comprise large numbers of so-called magnets, usually specially adapted electromagnets. Pipe organs are often fitted with pipe action-magnets, electromagnetic valves that control the admission of air into pipes, usually one magnet per pipe. Pipe organs are also often equipped with stop action-magnets, called SAM's, which are manually or electromagnetically operated switches used to select ranks of organ pipes. Musical instruments comprising no pipes may be fitted with SAM's to select ranks of sounds. U.S. Pat. No. 4,851,800 teaches pipe action-magnets and both tab-style and draw-knob SAM's, all typically used in pipe organs.

Pipe action-magnets are usually addressed and driven by circuitry located on driver cards, each card often servicing thirty-two or sixty-four pipes. Each pipe action-magnet usually has two coil terminals, one often connected in common with other pipe action-magnet terminals, and the other connected to an output of a driver card. A traditional pipe organ rank often comprises sixty-one pipes installed upon a wind chest having dimensions of several feet, with a driver card to service the pipes often located several feet away. If an average distance of ten feet from pipe to card be assumed, six-hundred-ten feet of wire is needed for the individual connections from card to pipes, not including common wiring. Since a pipe organ may comprise several tens of ranks totaling thousands of pipes, the wiring needed is often difficult and costly to install and maintain. U.S. Pat. No. 4,341,145 provides a pipe action-magnet comprising an electronic switch, allowing common connection of wires carrying large currents to pipe magnets and, permitting thinner wires to to control pipe action-magnets. This improvement reduces the wire cost and bulk, but not complexity, of pipe organ action-magnet wiring.

An organ is often fitted with one to three hundred stop action-magnets, or SAM's. Most SAM's comprise two coils, one to turn on a rank of sound, and another to turn it off, both usually addressed and driven by a driver card as with pipe action-magnets. To control ranks of sounds, each SAM additionally comprises one or more switches to which other parts of the musical instrument respond. These switches are usually wired to input cards that detect, and transmit to other parts of the organ, SAM position. Each input card may service perhaps sixty-four SAM switches. Thus, a SAM typically requires approximately thrice the individual, non-common, wiring, and thrice the card circuitry, of a pipe magnet. A theatre pipe-organ known to this inventor comprises about two-hundred-seventy SAM's, requiring a wiring harness, from a bolster upon which the SAM's are mounted to corresponding the driver cards mounted in the organ console, some six feet long and several inches in diameter and containing about eight-hundred wires.

To reduce SAM wiring, the Opus-Two SC Module is offered by Essential Technology of Kanata, Ontario, Canada. Being interposed in data and power wiring paths, such a module incurs added electrical connections.

Power consumption and resultant heat, and stray magnetic fields have hitherto militated against integration of either drive or decoder circuits into SAM's. Thus, a need remains for a musical instrument action-magnets and drivers that include drive and decoder, and signaling circuitry to provide simple, reliable, compact, and economical wiring and logic element reduction for control circuitry of musical instruments such as organs.

BRIEF DESCRIPTION OF THE INVENTION

In the present invention, musical instrument action magnets drivers and action-magnets are provided that integrate any or all of, drive circuitry, decoder circuitry, and signaling circuitry. Integral drive circuitry, decoder circuitry, or signaling circuitry according to this invention is directed toward reducing the complexity of musical instrument wiring and connections and, in some embodiments, toward logic element reduction. Embodiments of action-magnets and drivers according to the present invention may comprise any of, shift-registers, shift-cells, latch-cells, storage registers, micro-controllers, or combinations thereof, when integrated according to the teachings of this invention. Combined SIPO and PISO cells, registers, or both, may be embodied according to the present invention.

DETAILED DESCRIPTION OF THE INVENTION

Figure 1:
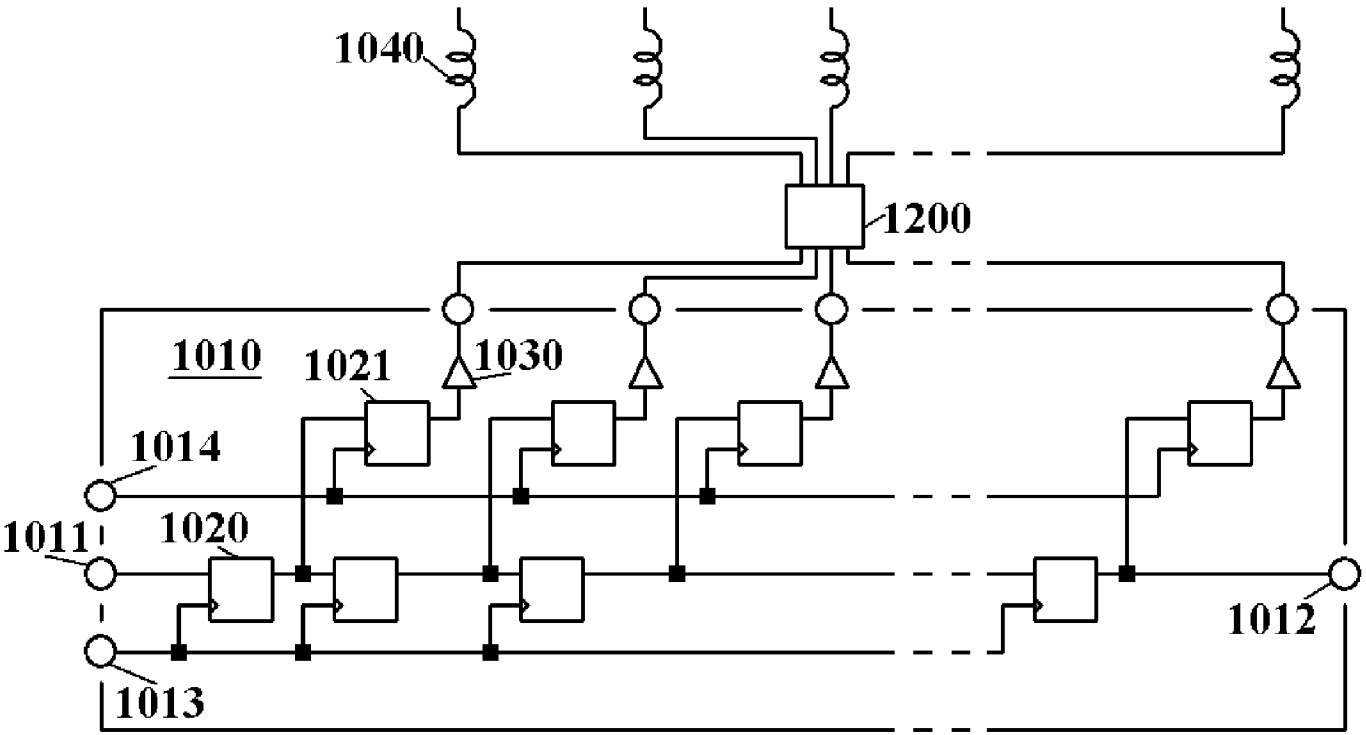
PRIOR ART Fig. 1
FIG. 1 depicts prior-art connection of a action-magnet driver board to action-magnets.

In this teaching, action-magnet means electromagnetic apparatus for controlling a musical instrument, exemplified by pipe action-magnets and stop action-magnets typically comprised by pipe organs. Other musical instrument action-magnets exist, such as those used to operate percussion devices of theatre pipe organs. Action-magnets are typically named according to components they control, for example, pipe action-magnets for controlling organ pipes and stop action-magnets, SAM's, for controlling ranks of organ pipes, often called organ "stops."

For some embodiments of this invention, this application teaches action-magnets comprising integral drive circuitry, and action-magnets and action-magnet drivers that may also comprise integral decoder circuitry, integral signaling circuitry or both. In this teaching, "integral" drive, decoder, or signaling circuitry, or micro-controller or shift-cell circuitry means:

a. Such circuitry built into an action-magnet, for example, such circuitry sharing an action magnet printed circuit board.
b. Such circuitry coupled, either permanently or by connectors, to an action-magnet or action magnet driver as a rider or "daughter" circuit board, by which the action-magnet or driver is interposed in either the data path, the power connection path, or both, between the drive, decoder, or interface circuitry and the instrument into which the action-magnet or driver is installed.
c. Such circuitry that is both electrically coupled, and mechanically joined to an action-magnet using such fasteners as screws, rivets, adhesives, or mounting rails.

Similarly, an integrated action-magnet or integrated action-magnet driver is defined as an action-magnet or driver comprising, in the manner defined in a., b., or c. above, circuitry cited above. Integrally comprising likewise means comprising in the manner defined above.

Other terms and concepts used in this teaching are defined as follows:

Action-magnet driver means apparatus comprising drive circuitry, which may additionally comprise other circuitry.

Drive circuitry means circuitry, often comprising an electronic switch, for applying electrical current to energize a coil comprised by an action-magnet.

Coil means an electromagnet coil for converting electrical current to magneto-motive force for operating an action-magnet.

Electronic switch means an active electronic component such as a MOSFET, BJT, IGBT, or thyristor for controlling current flow responsive to a signal.

Instruction an means electrical signal, emanating from controlling components of a musical instrument, to which other components such as action-magnets respond. Decoder circuitry means apparatus for processing instructions to operate an action-magnet or action-magnet driver, whether that magnet or driver is designed or programmed to decode traditional SAM coil ON and OFF signals, or a digital data with or without imbedded address data. To practice this invention, decoder circuitry may be embodied by discrete hardware or by a processor under program control.

Signaling circuitry means circuitry for electrical communication between musical instrument components, including action magnets.

The use of terms such as "logic 1" and "logic 0" in any part of this description are explanatory and arbitrary, and are not to be understood to limit this invention to a particular data polarity or word-width.

Shift register means a concatenation shift-cells that may comprise integrated circuits or even discrete components. A typical shift-cell is the type-D flip-flop like those of the common 74HC74, or an assemblage of suitably clocked transparent latches. A shift-cell according the present invention may comprise a so-called "bucket-brigade" circuit, or even an assemblage of suitably clocked transmission gates with suitably buffered storage capacitors. A shift-cell or a shift register may even comprise one or more micro-controllers. A shift register serially propagates data, responsive to one or more clock signals, from one or more data inputs, through shift-cells, to one or more data outputs. Though a simple shift register may comprise a simple concatenation of shift-cells between a single data input and a single data output, other forms of shift registers exist that relate to the present invention. In this teaching, a shift-cell is said to address an action-magnet when, through such circuitry as a latch-cell and drive circuitry, the action-magnet is responsive to data having been shifted into the shift-cell. The shift-cell correctly addresses an action-magnet when desired data is usefully aligned therein. A shift register according to this invention may comprise either a distributed or concentrated concatenation of shift-cells. According to this invention, a shift-cell, when used as described below, is decoder circuitry. Although, in the embodiments of the present invention that follow, shift-cells or emulated shift-cells are preferred for addressing action-magnets drivers and action-magnets, the present invention is practiced when integral decoder circuitry as defined above performs address recognition.

A SIPO, Serial-Input-Parallel-Output, register is typified by the common 74HC164. In a SIPO register, a serial data stream is clocked into shift-cells, each of which comprises a parallel output. If its clock is stopped when each data bit resides in a desired shift-cell, each parallel output will desirably represent one bit of the serial data stream. In this teaching such clocking is called a "correct" number of clock pulses. A SIPO register may further comprise latch-cells, often type-D flip-flops, or transparent latches, that may be pulsed after a correct number of clock pulses to store the desired parallel data while clocking of shift-cells continues unabated. Such latch-cells, commonly interposed in the parallel data path to the SIPO outputs, may be seen in the common 74HC595.

A PISO, Parallel-In-Serial-Output, register is typified by the common 74HC165. In this register, parallel data is loaded into shift-cells responsive to a shift/load signal whereby it lies correctly aligned in the register. When the shift/load signal returns to a shift mode, subsequent clock pulses shift data toward a serial output of the PISO register. The first data bit to appear at the serial output is that of the shift-cell connected thereto. When a "correct" number of clock pulses have been asserted the data from the cell furthest from the serial data output emerges. Thus, parallel data is converted to a serial data stream.

Modern electronic practice often predicates integrating a maximum number of logic elements into an integrated circuit or onto a circuit board, a practice vital to wiring reduction in computers, where whole systems may be microscopic. However, as in organs, where large numbers of macroscopic components such as pipes and SAM's must be controlled, such integration can incur wiring problems. Even the integration of eight shift-cells and eight latch-cells seen in the common 74HC595 can yield sub-optimal musical instrument wiring. As will be taught below, two flip-flops, typical in the common 74HC74, yield efficient wiring in integrated pipe action-magnet drivers, and integrated SAM's may be made almost as simply.

Some semiconductor integration solutions can be very useful for solving such problems, as will be shown below. Integrated micro-controllers, exemplified by Microchip Technology PIC™ products, are so capable and inexpensive that their use to emulate shift-cells, latch-cells, decoders, and other action-magnet circuitry can prove more economical in production than some simple embodiments taught below for clarity.

In the figures that follow, power and common wiring has largely been omitted inasmuch as it occurs to a similar extent in both traditional applications and according to this invention. Referring first to FIG. 1, a typical driver card 1010 is shown driving a terminal 1017 of a coil 1040 through one wire of a wiring harness 1200. Coil 1040 is comprised by one of a multiplicity of pipe magnets, of which four are depicted. Sixty-one coils 1040 are often driven by one card 1010 requiring sixty-one wires in wiring harness 1200. Since many organs comprise tens of ranks, each requiring a wiring, organ pipe wiring is often both extensive and expensive.

Driver card 1010 has a serial data input terminal 1011 and a clock input terminal 1013. Serial data is clocked into a first shift-cell 1020 and shifted through a multiplicity of identical cells, of which four are depicted. If plural such cards are concatenated, data shifts out of a serial output terminal 1012 and into a terminal 1011 of the next driver card in the chain. An input of a first latch-cell 1021, of which four are shown, connects to an output of shift-cell 1020, as subsequent latch-cells connect to subsequent shift-cells. These two cell types thus connected form a SIPO register. When the driver card (or cards) has (have) been clocked as many times as the total number of shift-cells, a "correct" number of clock pulses, the serial data word having been shifted into the SIPO register lies desirably aligned therein. At that time a latch pulse is asserted on latch terminal 1014 to store the now-parallel data in latch-cells 1021. An output of each latch-cell 1021 is connected a drive circuitry 1030 which, responsive to the data stored in the latch cell, turns on or off the coil 1040 of the pipe magnet to which it is connected.

Figure 2:
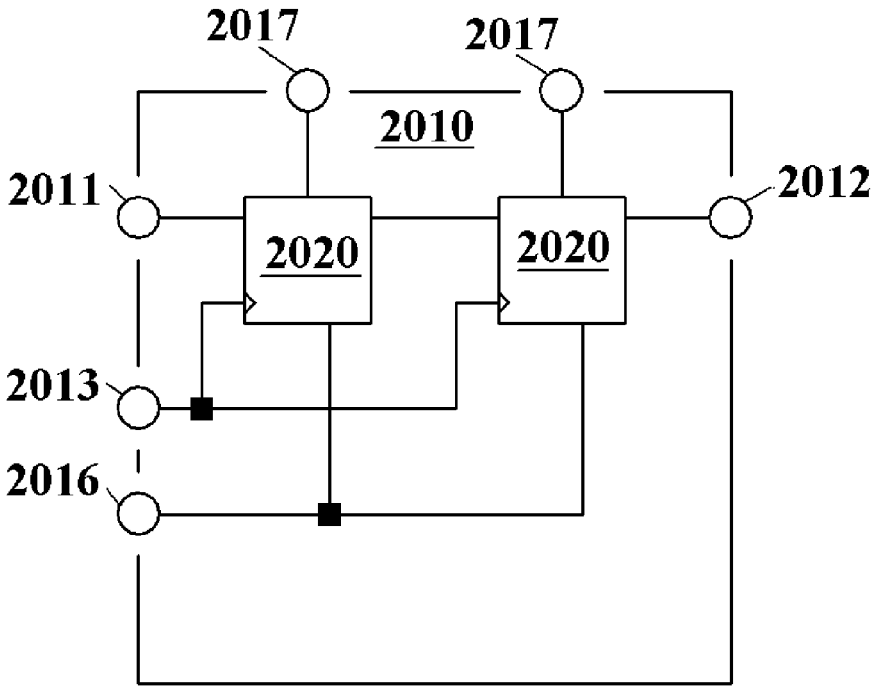
Fig. 2 PRIOR ART
FIG. 2 is a simplified diagram of a prior-art SAM input board.

FIG. 2 depicts an input card 2010 for two SAM's, forming Parallel-In-Serial-Out, PISO, register comprising two shift-cells 2020. It should be understood that a typical input card would comprise many more than two cells. Input card 2010 also comprises a serial data input terminal 2011, a clock input terminal 2013, and a data output terminal 2012, similar to the driver card of FIG. 1. Input card 2010 has, in addition, parallel input terminals 2017, one for each of its cells, and a load terminal 2016. When a load pulse is asserted on terminal 2016, parallel data at terminals 2017, typically representing SAM position, is stored in shift-cells 2020. When input card 2010 is subsequently clocked, the SAM position data having been stored therein exits serial output 2012 as a serial data stream to signal SAM positions to organ components.

Figure 3:
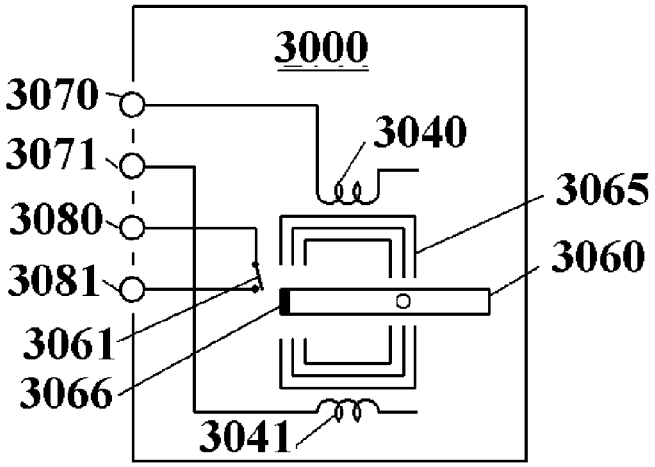
Fig. 3 PRIOR ART
FIG. 3 is a simplified diagram of a prior-art SAM.

FIG. 3 is a simplified representation of a typical two-coil SAM 3000, having an ON coil 3040 and an OFF coil 3041, and fitted with a magnetic circuit 3065 that is completed by a sector-rotating armature 3060 which can be toggled by energizing either coil 3040 or 3041, or manually by an organist. Armature 3060 is often fitted with a permanent magnet 3066 to activate a reed switch 3061 when SAM 3000 is ON. Terminals 3070 and 3071 are used to connect SAM 3000 to a driver card, usually another card 1010 as shown in FIG. 1. One of terminals 3080 and 3081 is typically used to connect SAM 3000 to an input card such as that shown in FIG. 2.

Figure 4:
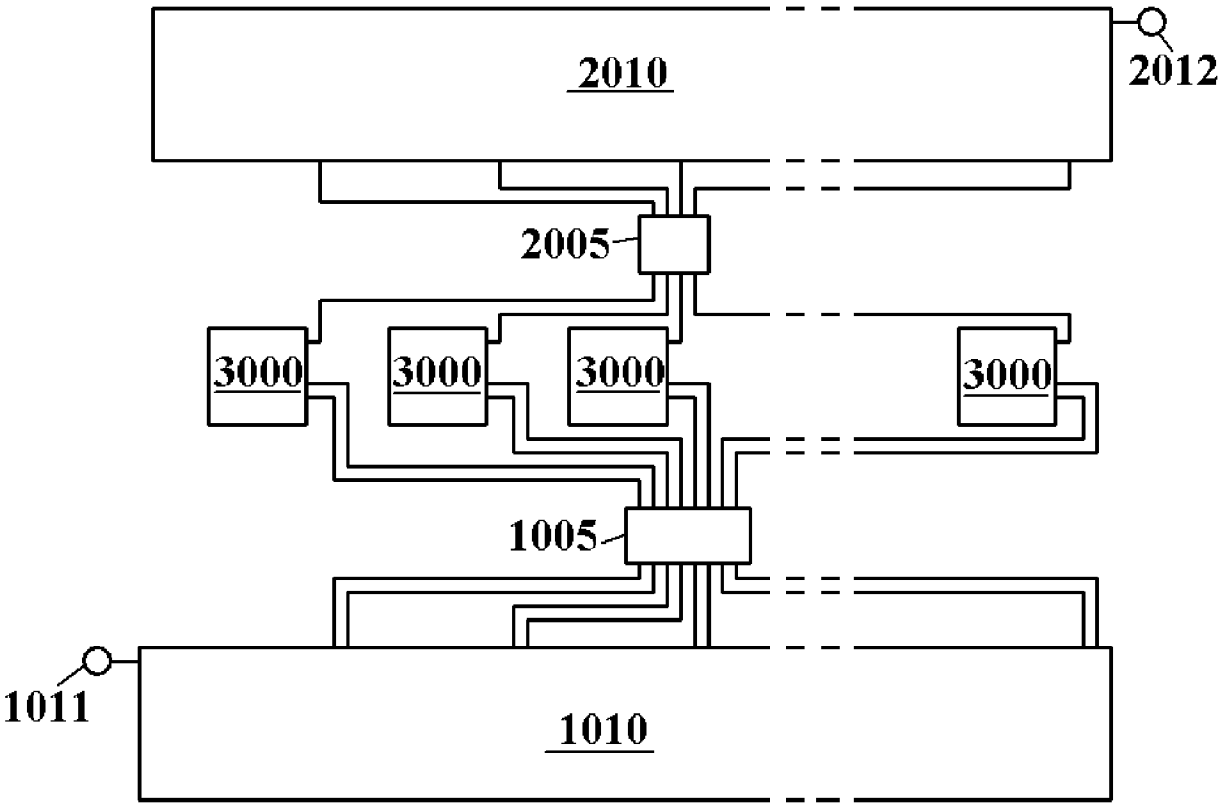
Fig. 4 PRIOR ART
FIG. 4 depicts prior-art wiring of SAM's with driver and input boards.

FIG. 4 shows an array of four typical SAM's 3000 with a driver card 1010 having a serial data input 1011, and an input card 2010 having a serial data output 2012. Though only four SAM's 3000 have been shown here, hundreds of such SAM's are typical. One may appreciate the immensity of traditional wiring harnesses needed for hundreds of SAM's 3000.

Figure 5:
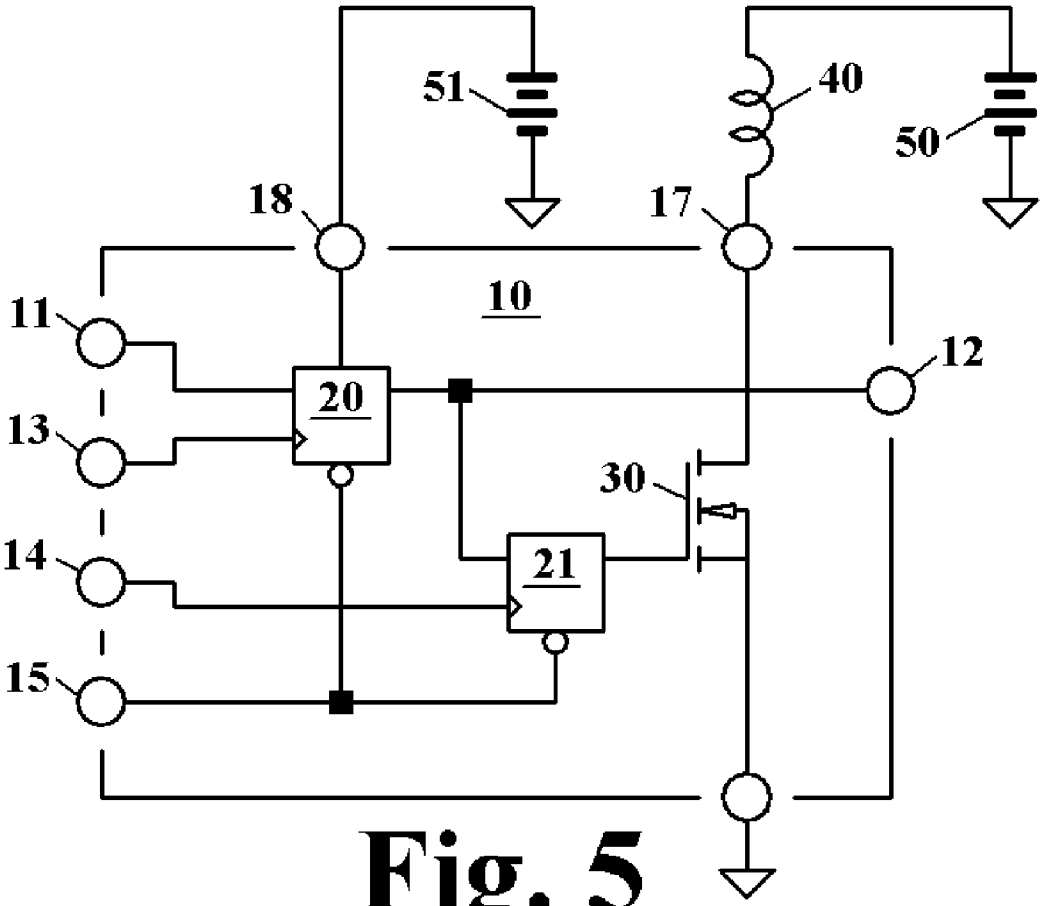
FIG. 5 is a simplified diagram of a pipe action-magnet according to the present invention.

FIG. 5 depicts a pipe action-magnet driver 10 according to the present invention. A serial input terminal 11 receives a serial data stream and a serial output terminal 12 outputs a shifted serial data stream. A shift-cell 20 is clocked by a clock signal from a clock terminal 13. This driver is designed to be concatenated with other such drivers. A concatenation thus formed constitutes a distributed SIPO shift register. When a "correct" number clocks pulses have been asserted, the serial data having been shifted in through terminal 11 lies aligned in shift-cell 20 to provide a desired parallel output. At this time a load pulse asserted on terminal 14 stores in a latch-cell 21 the data to which the associated pipe magnet coil 40 controlling its pipe 60 responds. Thus, through this data alignment, the concatenation embodies decoder circuitry. Each action-magnet driver 10 is hopefully located close to the pipe 60 it controls rather than being grouped with other drivers as is traditional.

The parallel data from latch-cell 21 drives an electronic switch 30, in this case an N-channel MOSFET, the drive circuitry of action-magnet driver 10. If the data latched indicates that the pipe 60 controlled should speak, switch 30 is closed putting the coil 40 of the pipe magnet, through terminal 17, in circuit with a voltage source 50, typically 12V.

Thus the pipe magnet causes air to be admitted to pipe 60 to make it speak. If the parallel data is opposite, switch 30 is turned off and pipe 60 ceases to speak. Terminal 15 is provided for resetting driver 10. A common dual type-D flip-flop, the 74HC74, or equivalent, is suitable for this driver, one half being used as the shift-cell 20, and its other half being used as latch-cell 21. Cells 20 and 21, by receiving data and control signals through terminals 11 and 13-15, by transmitting data through terminal 12, and by switch 30 actuating coil 40 through terminal 17, function as signaling circuitry. Pipe action-magnet driver 10 and the pipe magnet comprising coil 40 may either be integrated into a single assembly as shown below or separately embodied to practice this invention. Though one might choose to locate driver 10 far from the pipe magnet and the pipe 60 it controls, doing so might waste wire. The design pipe of action-magnet driver 10 facilitates its location close to the pipe 60 that it controls to minimize wiring. Since terminal 12 of one driver 10 feeds terminal 11 of the next, one conductor per pipe action-magnet driver 10, through which the data for many drivers may pass, connects adjacent pipe action-magnet drivers 10.

Figure 6:
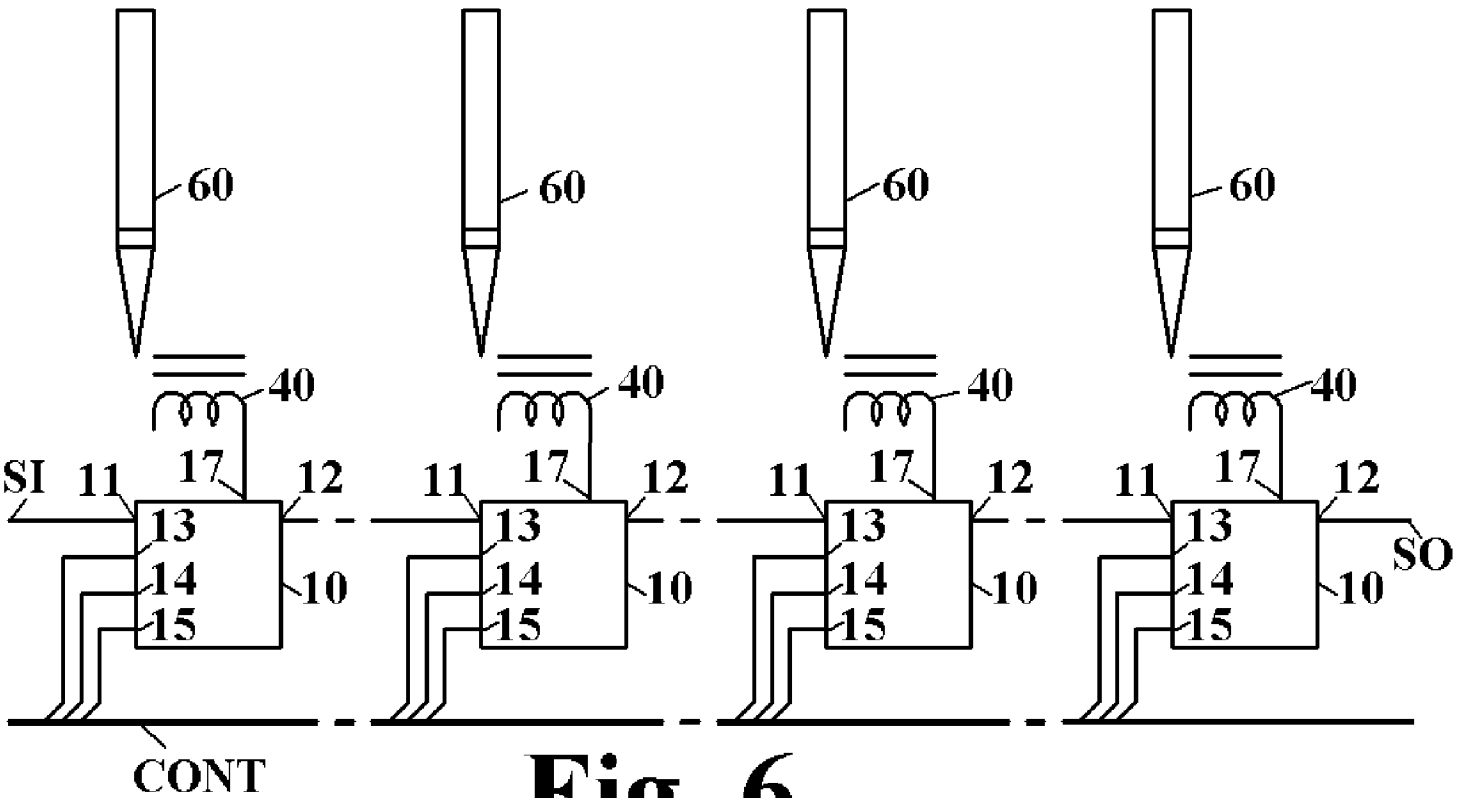
FIG. 6 shows wiring, to organ pipes, of integrated pipe action-magnets according to the present invention.

FIG. 6 shows a SIPO register comprising four pipe action-magnet drivers 10 according to FIG. 5, each driving the coil 40, of a pipe action-magnet associated with an organ pipe 60. As can be appreciated, if the pipe action-magnet is near its driver 10, the conductor from terminal 17 to coil 40 can be short. Each serial output terminal 12 is shown connected to serial input terminal 11 of a following driver. Terminal SI is the serial data input of the concatenation of drivers 10 also having a serial output SO. If many such drivers 10 be concatenated, relatively little individual wiring is needed compared to typical organ pipe wiring. Since terminals 13, 14, 15, and 18 of FIG. 5, are common to such a chain of drivers 10, a control cable CONT of few conductors, typically a well-known ribbon cable assembled with well-known insulation displacement connectors (IDC's) suffices for common terminals of many drivers 10. This concatenated register comprising concatenated drivers 10 performs both the SIPO function and the coil-drive function usually performed by one or more multiple-output driver cards located at a distance from the organ pipe magnets. Though only four pipe action-magnet drivers 10 are depicted here, a concatenation of sixty-one would be typical.

Figure 7:
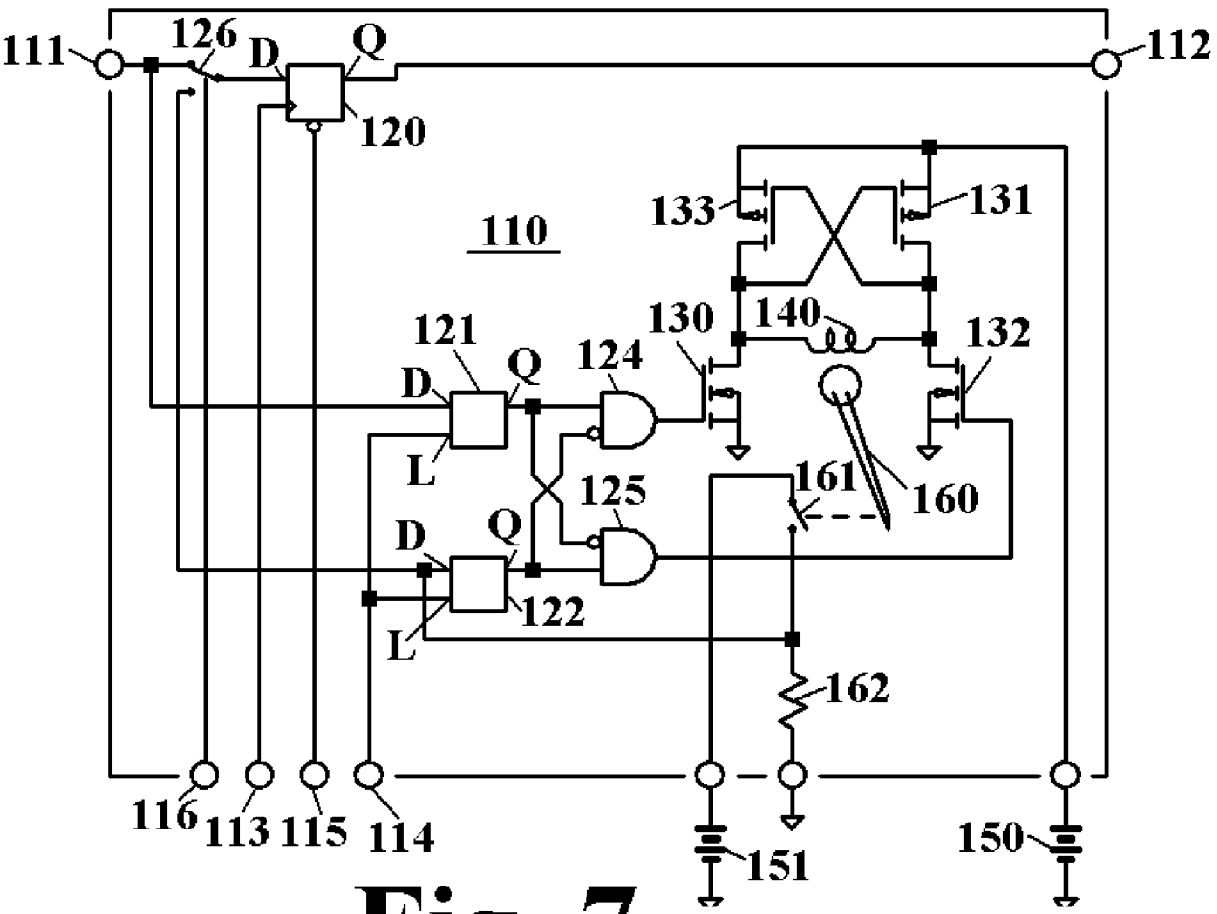
FIG. 7 is a simplified diagram of an integrated SAM according to the present inventions embodied with discrete logic.

FIG. 7 depicts a SAM 110 according to the present invention that simply illustrates inventive aspects of such a SAM. SAM 110 comprises drive circuitry, decoder circuitry and signaling circuitry, as will be shown below. SAM 110 comprises a shift-cell 120 and a latch-cell 121 that receive and store, respectively, data, as do corresponding cells of pipe action-magnet driver 10 of FIG. 5, Thus these cells embody decoder and signaling circuitry. A serial data input terminal 111 receives a serial data stream, either from other musical instrument parts or from a preceding concatenated SAM 110. At most times a multiplexer 126 connects serial data at terminal 111 to an input D of a shift-cell 120. Clock pulses from a clock terminal 113 clock this data through shift-cell 120 to be shifted out of serial data output terminal 112 and into any following concatenated SAM's 110. When a "correct" number of clock pulses have been asserted, desired data for this SAM 110 abides at its terminal 111 and at a D input of a transparent latch 121. At this time a data latch pulse is asserted on terminal 114 and at an input L of latch 121, and terminal 111 data passes to an output Q of latch 121.

Switch 161 is operated by rotor 160 to be closed when the mechanical portion of SAM 110 is in an ON, or actuated position, putting in circuit a resistor 162, and a logic supply 151, usually 5V, creating a logic 1 at the junction of switch 161 and resistor 162, at an input D of a transparent latch 122, and at a terminal of multiplexer 126. In like manner, if a mechanical OFF position occurs in the SAM 110, a logic 0 appears on the same node. Since the data latch pulse also appears at an input L of latch 122, the switch data is passed during that pulse to an output Q of latch 122. The data latch pulse is relatively short and when it falls the data in both latches 121 and 122 is stored until the next data latch pulse. If SAM 110 is already in a desired position, the data at the outputs Q of both latches 121 and 122 matches. Gates 124 and 125 process this data and, it being matched, neither gate issues a logic 1. If the data received is a logic 1, but SAM 110 is OFF, gate 124 issues a logic 1, enhancing an NMOSFET 130, which turns ON, pulling down the gate of a PMOSFET 131, turning it ON also. Thus coil 140 is placed in circuit with a power supply 150, usually 12V. In this case current flows from right to left through coil 140 until the next data latch pulse. The time between data latch pulses is preferably about 100 mS, sufficient to assure that SAM 110 will toggle to the desired position. In like manner, if the data is a logic 0 and SAM 110 is in the ON position, gate 125 enhances a MOSFET 132 which enhances MOSFET 133, causing an opposite current in coil 140 to toggle SAM 110 OFF. Thus MOSFET's 130 through 133 are comprised by the drive circuitry of SAM 110 of this figure. An ON or OFF pulse endures for the approximately 100 mS period between data latch pulses.

Thus far this description of FIG. 7 has addressed only the SIPO function of a register comprising shift-cells of concatenated SAM 110's. Serial input data is processed to toggle SAM's, paralleling the function of pipe magnet drivers 10 of FIGS. 5 and 6. Now a PISO function of the SAM 110 register will be taught. Subsequent to serial data being "correctly" aligned in shift-cell 120 of a SAM 110, and having been latched according to the aforementioned SIPO register function, any serial data abiding in shift-cell 120 becomes obsolete. If, at that time, a switch data load pulse is asserted on terminal 116 until the rising edge of the next clock pulse on terminal 113, multiplexer 126 will pass switch 161 data to shift-cell 120 and, upon that next clock pulse, the obsolete data in shift-cell 120 will be replaced with SAM position data loaded from switch 161. Clocking subsequent to such loading both propagates new SAM serial data at serial input 111 into a concatenated register of SAM's 110, and also serially shifts out from terminal 112 of the last SAM 110 thereof, SAM position data having been loaded into shift-cells 120. This data, a serial data stream representing positions of the SAM's 110 comprised by the concatenated register, may be transmitted to other parts of a musical instrument. SAM 110 thus embodies additional signaling circuitry compared to a pipe action-magnet driver of FIG. 5.

As described above, the same shift register comprising concatenated SAM's 110 performs both the SIPO function of traditional driver cards and the PISO function of traditional input cards. This multiple use according the present invention can reduce not only reduces musical instrument wiring, but also logic elements needed. Traditionally, as shown in prior-art FIG. 4, two serial paths have been embodied, one path through SIPO registers to drive SAM,s, and another path through PISO registers to receive switch data. The SAM of this embodiment enables departure from that tradition using a serial path for both functions. An aspect of present invention is the use of a shift-cell addressing an action magnet to perform both SIPO and PISO functions. Though single serial data paths are preferred for integrated SAM's according to this invention, this invention contemplates integrated SAM's with plural serial data paths.

Since it is desirable to minimize delay between a musician's operation of SAM's 110 and an instrument's response, switch data load pulses may be asserted at a higher frequency than data latch pulses, the latter being necessarily of low enough frequency to obtain a desired duration of about 100 mS between pulses, as explained above.

It should be understood that the embodiment of this figure, though proven in practice, is not preferred. This embodiment is included to introduce inventive aspects that might be less evident to some were only the preferred embodiment depicted below taught.

Figure 8:
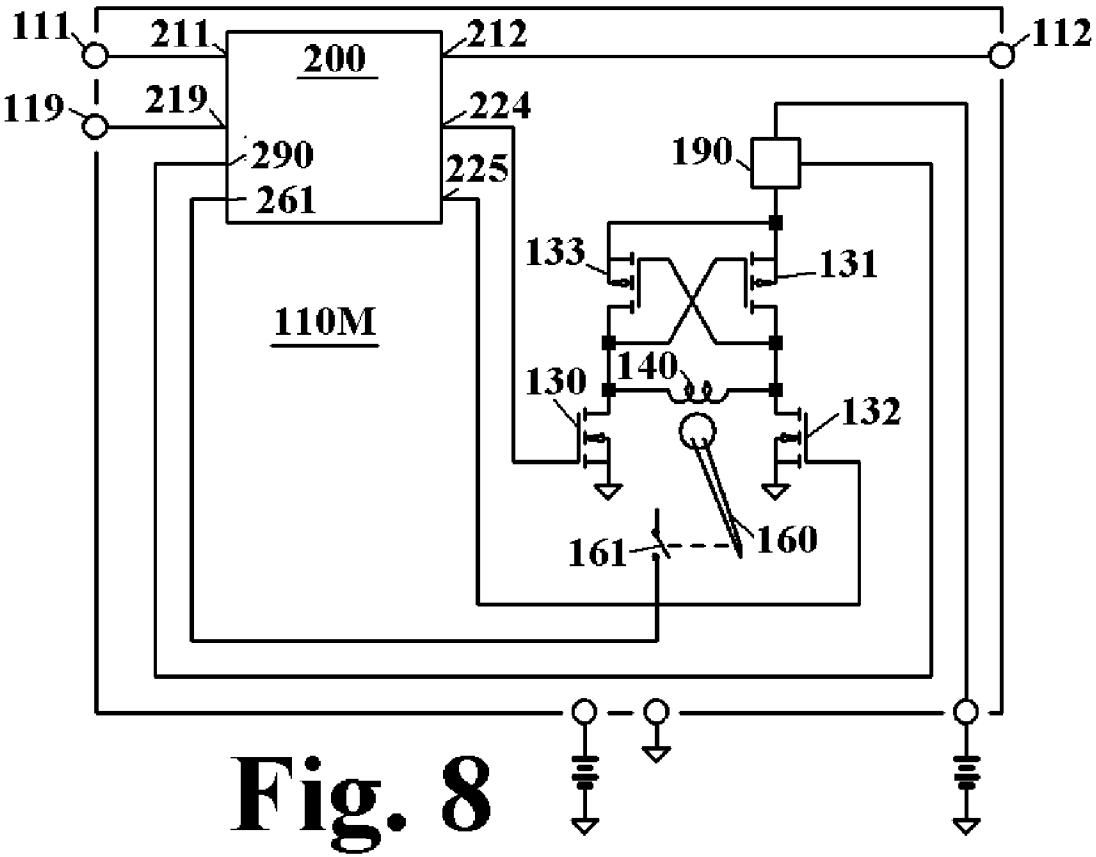
FIG. 8 is a simplified diagram of the preferred, micro-controller-based, embodiment of a SAM according to the present invention.

FIG. 8 depicts a SAM 110M, a preferred embodiment of the present invention, like the SAM 110 of FIG. 7, but using a micro-controller 200 to emulate the functions having been conceptually introduced in the explanations of the discrete logic of FIG. 7. These functional emulations will be addressed in more detail in subsequent figures. This embodiment reduces wiring and cost compared to FIG. 7, while enabling versatility, as will be cited below.

The SAM 110M of this figure has a serial input 111 that functions as does its counterpart in FIG. 7, connecting to an input 211 of micro-controller 200. SAM 110M of this figure also has a serial output 112 that that functions as does its counterpart in FIG. 7, connected to an output 212 of micro-controller 200. Two micro-controller 200 outputs, 224 and 225, enhance MOSFET's 130 and 132 respectively to energize coil 140 to toggle rotor 160 and switch 161, just do the outputs of gates 124 and 125 of SAM 110 of FIG. 7. Instead of feeding logic as in FIG. 7, switch 161 feeds a micro-controller 200 input 154. Since SAM's operate very slowly compared to micro-controllers, the functions of terminals 113-116 of SAM 110 of FIG. 7 are here merged into a single instruction terminal 119 which connects to an input 219 of micro-controller 200. Micro-controller 200, receiving instruction pulses through terminal 119, temporally parses them to implement actions corresponding to the actions implemented by the non-merged terminals of SAM 110 of FIG. 7, as will be explained below. It is practical to embody this invention further merging the functions of terminals 111, 112, and 119 into a single terminal using such a protocol as a well-known single-wire net, also known as a MicroLAN. Such merging needs address recognition circuitry embodied within SAM 110M. To avoid such complication, and to simplify this explanation, the preferred embodiment of this figure uses micro-controller 200 to emulate the shift-cell operation of the discrete logic of FIG. 7. Thus SAM 110M of this figure embodies the same functions as that of FIG. 7. Two bits of a micro-controller 200 internal register may be used to emulate the master and slave functions typical of a type-D flip-flop shift-cell like that of FIG. 7. A suitable micro-controller 200 for a SAM 110M according to this figure is exemplified by the Microchip Technologies part no. PIC16F505, which comprises a precise internal timer.

Additional to the aforementioned functions, and shown in this figure, SAM 110M may be fitted with over-current protection circuitry 190 which may be placed in circuit with MOSFET's 131 and 133, to deliver an over-current signal to micro-controller 200 input 290, whereby micro-controller 200 may responsively cease to enhance MOSFET's 130 and 132. A SAM 110 according to FIG. 7 may also be similarly fitted with such protective circuitry.

Figure 9A:
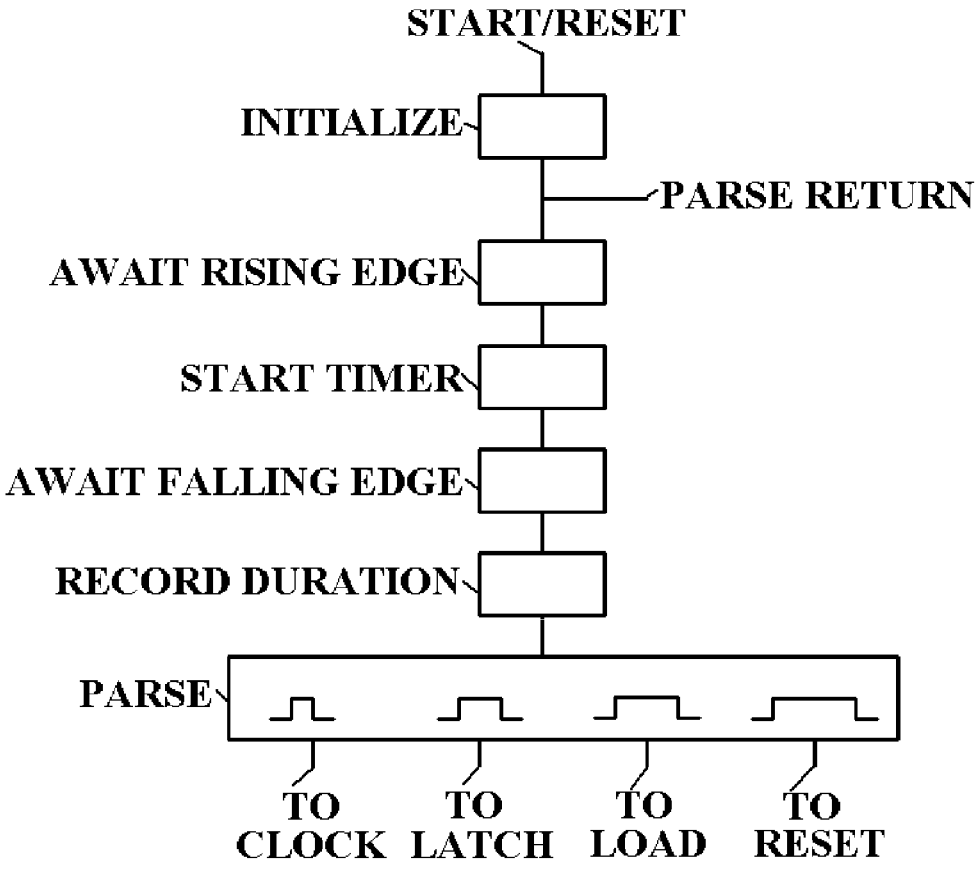
FIG. 9A is a simplified flow diagram of a instruction parsing routine for operating the embodiment of FIG. 8.

FIG. 9A is a simplified flow diagram showing the initialization and instruction parsing section of a program which may be embodied in micro-controller 200 of SAM 110M according to FIG. 8 to execute its function. Upon starting or reset, an initialize routine, INITIALIZE, sets up the registers of micro-controller 200. Thereafter, or upon returning from a later routine, the program awaits a rising edge, AWAIT RISING EDGE, of a instruction pulse on terminal 119 of FIG. 8. Upon receiving the rising edge, execution starts the above mentioned precision timer, START TIMER, of micro-controller 200. Then execution awaits a falling edge, AWAIT FALLING EDGE, at terminal 119. Upon receiving the falling edge, an output of the timer, representing elapsed time between the rising and falling edge is stored, RECORD DURATION, in an internal register of micro-controller 200. The duration data in this register is parsed, PARSE, to direct program execution along one of four paths. The shortest pulse selects a path, TO CLOCK, to a clock routine which performs the same function as clocking the shift-cell 120 of FIG. 7. The next longest pulse selects a path, TO LATCH, to a latch routine which performs the same function as the data latch pulse of FIG. 7 to perform the described SIPO function thereof. The third longest pulse selects a path, TO LOAD, to a load routine that functions as does the switch data load pulse of FIG. 7 to perform the described PISO function thereof. The longest pulse selects a path, TO START/RESET, to the beginning of the program. Thus, through the single instruction terminal 119 the functions implemented by several signaling terminals of SAM 110 of FIG. 7 are emulated.

Figure 9B:
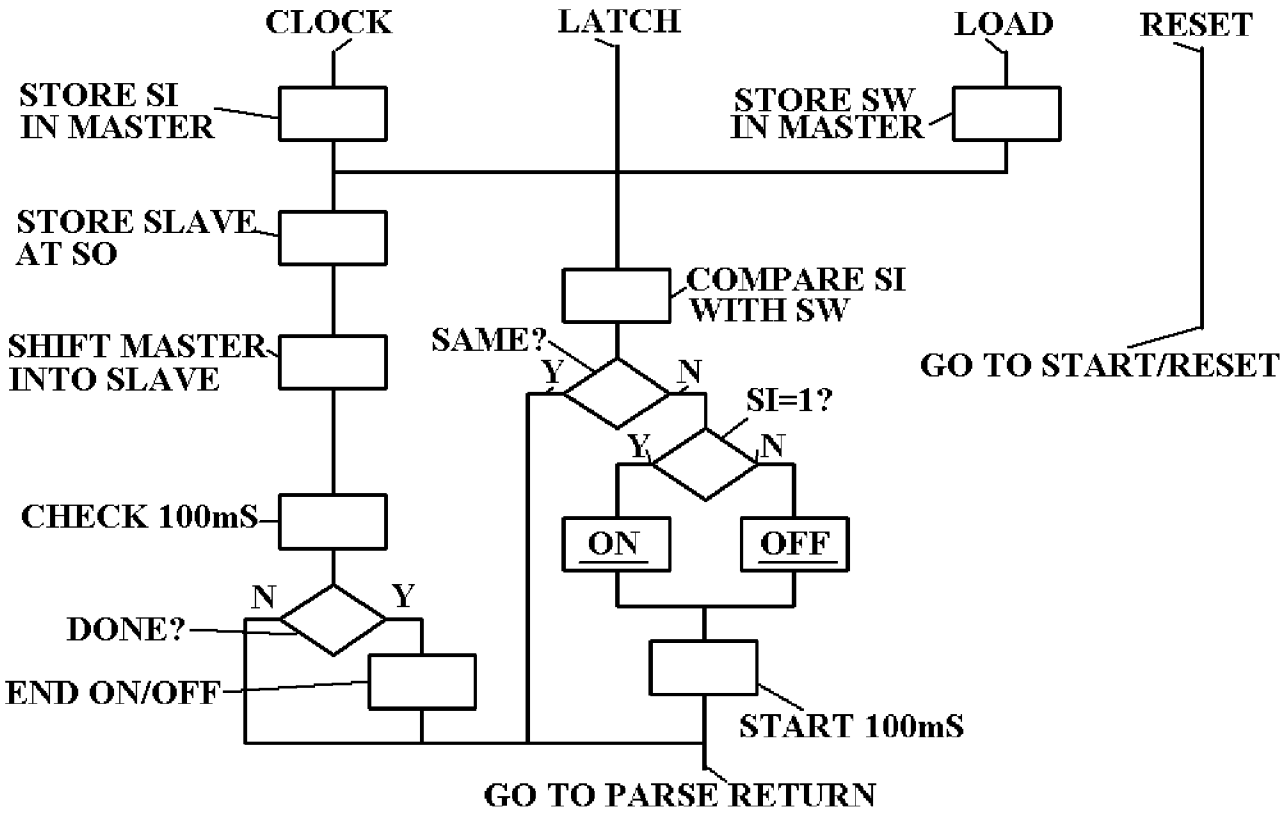
FIG. 9B is a simplified flow diagram of instruction execution routines for operating the embodiment of FIG. 8.

FIG. 9B is a simplified flow diagram of the paths that may be invoked by the parsing routine shown in FIG. 9A. The clock, CLOCK, path first stores, STORE SI IN MASTER, serial input data at terminal 111 of FIG. 8 into the above-mentioned master bit of register within micro-controller 200. Then the data in the aforementioned slave bit is transferred, STORE SLAVE AT SO, to an internal output register of micro-controller 200, to appear at serial output terminal 112. With output data stored, the master bit data is then transferred, SHIFT MASTER INTO SLAVE, to the slave bit. The steps of this figure cited above emulate clocking of the shift cell 120 of FIG. 7. Lastly, an internal register storing data regarding a 100 mS time to be discussed below is checked, CHECK 100 mS. If the 100 mS has not, N of DONE?, expired, the program returns, GO TO PARSE RETURN, to the parse routine of FIG. 9A. If the 100 mS has, Y of DONE?, expired, any pulses having been initiated by the latch routine discussed below are terminated, END ON/OFF, prior to returning, GO TO PARSE RETURN, to instruction parsing.

The latch, LATCH, path of FIG. 9B first compares, COMPARE SI WITH SW, data at terminal 111 of FIG. 8 with switch data from switch 161 of FIG. 8 indicating the position of rotor 160 of FIG. 8. If the data matches, Y of SAME?, the SAM is in the desired position and the path returns, GO TO PARSE RETURN, to the parse routine of FIG. 9A. If the data, does not match, N of SAME?, and the serial data at terminal 111 of FIG. 8 is a logic 1, Y of SI=1?, the "ON" output 224 of micro-controller 200 of FIG. 8 is exerted to toggle the SAM 110M to its "ON" position. Conversely, if the data is not a logic 1, N of SI=1?, terminal 225 of micro-controller 200 is exerted to toggle the SAM 110M to its "OFF" position. Since SAM 110M of FIG. 8 is an electromagnetic device having inertia, an approximately 100 mS pulse is programmed to assure toggling. After either terminal 224 or terminal 225 of micro-controller 200 of FIG. 8 is turned exerted, a 100 mS time duration is begun, START 100 mS., during which an internal register of micro-controller 200 counts instructions, typically spaced about 128uS apart, to measure duration since the 100 mS pulse was begun. Thus the data latch pulse period response of the SAM 110 of FIG. 7. is emulated.

The aforementioned 100 mS register check performed in the clock path above, and also in the load path discussed below, determines whether the 100 mS has expired and, if it has expired terminates either an "ON" or an "OFF" output exertion of micro-controller 200 of FIG. 8 to emulate the termination of a corresponding pulse of the SAM 110M of FIG. 8 by a subsequent data latch pulse.

The load path of FIG. 9B is nearly identical to the clock path, the difference being that instead of SI data being loaded into the master bit, SW data is loaded to perform the PISO function. The steps of this load path emulate the load switch data pulse response of the SAM 110 of FIG. 7.

The reset path of FIG. 9B simply returns to the start/reset origin of the program in FIG. 9A. This reset path emulates the reset pulse response of the SAM 110 of FIG. 7.

It should be understood that the present invention may be practiced using varied programs and hardware modifications. The simple program described above uses less than 10% of both the program memory and random access memory within an aforementioned PIC 16F505 micro-controller, making it practical to implement, using the same or an equivalent controller, an address recognition routine to facilitate single-wire communications. However, such an embodiment would not be as simple to explain as this teaching. The micro-controller 200 of SAM 110M of this invention can be be programmed to make a SAM 110M responsive to MIDI signals. The hardware of the SAM of FIG. 8, with a different program for which a typical micro-controller 200 has superfluous capacity, can be programmed to function as a "retrofit" SAM 110M, responding to ON-coil and OFF-coil signals intended to drive a traditional SAM. In such a version SAM 110M comprises a decoder of legacy signals, but not the shift-cell function described above. It remains, however, an integral SAM 110M according to this invention. With minimal change, the same SAM 110M can contain both the program described in FIGS. 9A and 9B, a "retrofit" SAM program, and additional programs, with a desired program being selectable under either hardware or software control.

Figure 10:
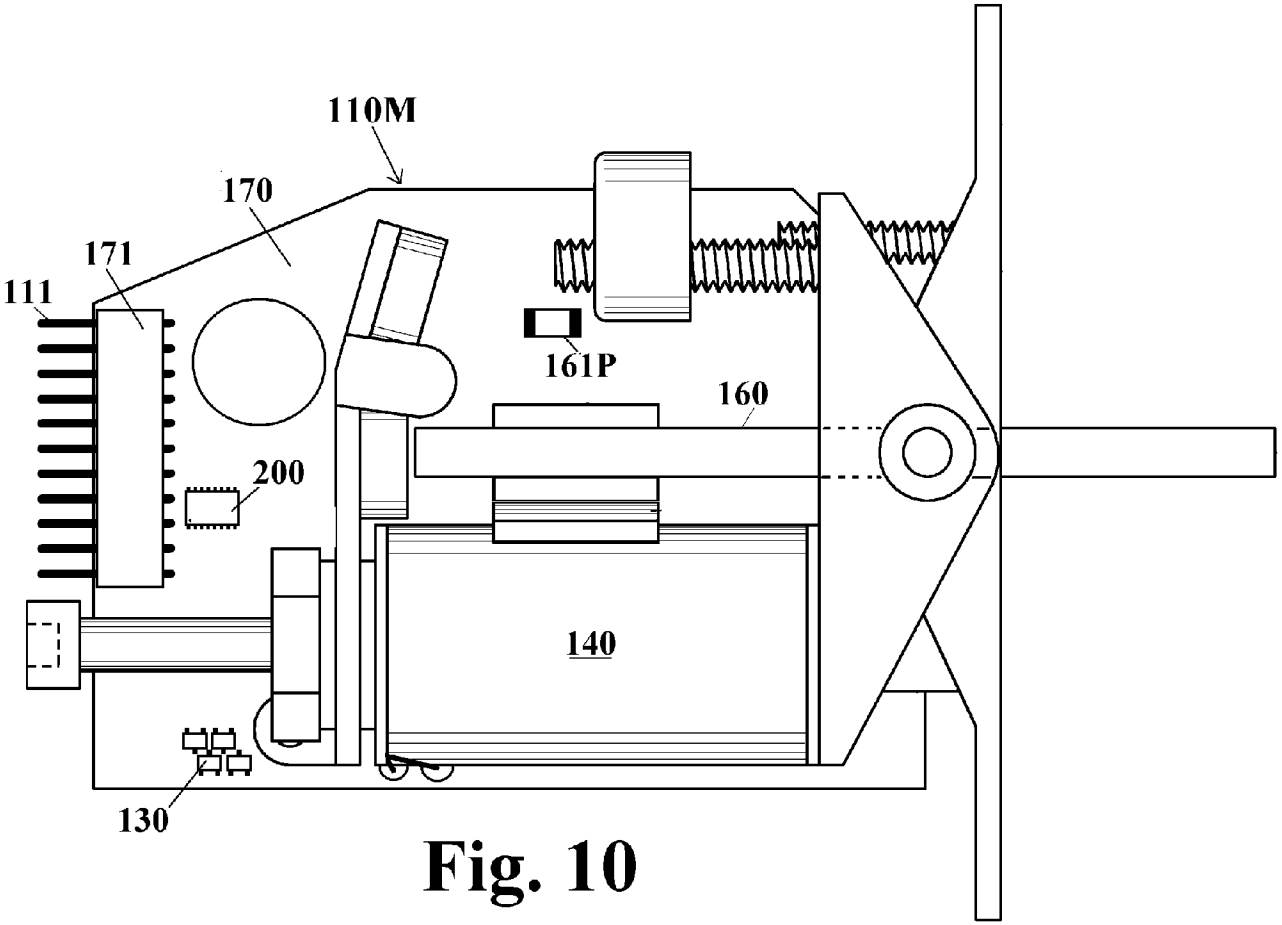
FIG. 10 depicts an integrated SAM according to the present invention.

FIG. 10 shows an integrated SAM 110M according to the present invention. SAM 110M has a rotor 160 that is toggled between positions by magneto-motive force produced by current in a coil 140. The toggling of rotor 160 responsive to current in coil 140 is described in detail in U.S. patent application Ser. No. 13/374,399, which also teaches other aspects of a preferred mechanical embodiment for this SAM 110M. This invention may also be practiced in a traditional two-coil SAM, predicated upon thermal considerations.

A switch sensor inductor 161P is preferred to provide data responsive to the position of rotor 160, replacing the reed switch of a typical SAM. The switching circuitry and operation of switch sensor inductor 161P is described in detail in U.S. patent application Ser. No. 13/136,369, which teaches many aspects of the preferred switch of this SAM. A traditional reed switch may also be used to practice this invention.

Coil 140 is driven by MOSFET switches as described above, one of which, 130, is depicted in this figure. Small MOSFET,s, typically in well-known SOT23 packages, suffice in the preferred embodiment of this SAM because of its low coil power, initially about one-third of that of two-coil SAM's, and in later prototypes reduced by use of rare-earth magnets and geometry improvements to about one-fifth that of typical SAM's. These MOSFET switches are comprised by the drive circuitry that resides on the circuit board 170 of this SAM. This board also comprises a micro-controller 200. Terminal 111, a serial input terminal, typifies plural terminals of a connector 171 depicted comprising it, and typifies the plural terminals depicted in FIG. 8. A connector 171 as depicted may be conveniently mated with a known IDC pressed onto a well-known ribbon cable, conveniently providing common connections for many SAM's according to this invention with but little labor.

The SAM 110M of this figure, when programmed as preferred and shown in FIGS. 9A and 9B, embodies many important aspects of this invention. It has integral drive, decoding, and signaling circuitry, embodies combined SIPO and PISO function in its emulated shift-cell, and embodies these aspects using a micro-controller 200.

Figure 11:
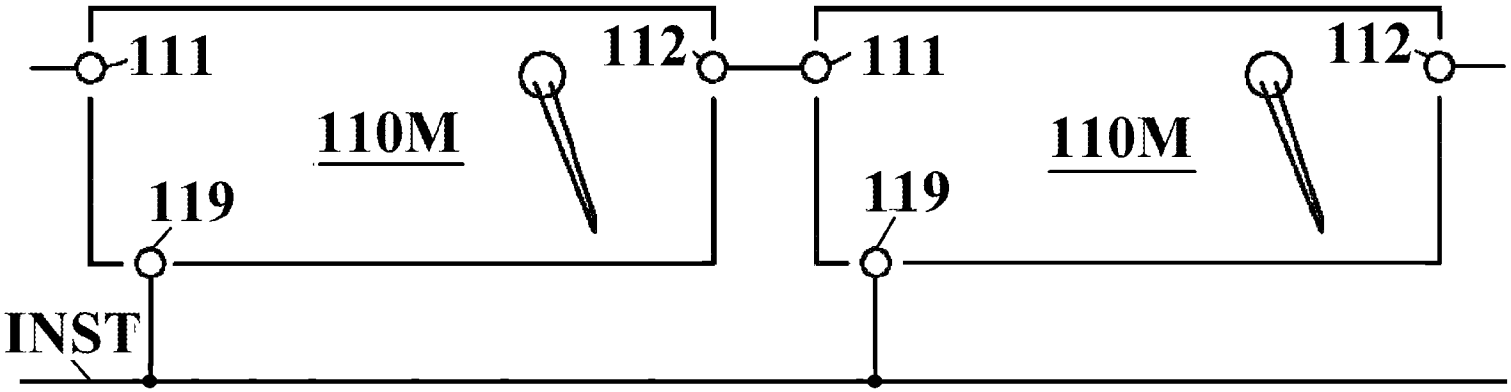
FIG. 11 shows wiring of SAM's according to the present invention.

FIG. 11 shows two SAM's 110M, representing but a small portion of a typically much longer concatenation of SAM's 110M. A common instruction line INST conducts instruction signals to terminal 119. Note that, unlike traditional configurations of SAM's, a single serial data path through a concatenation of SAM's suffices for both coil and switch data. SAM's being typically being mounted on approximately one-inch centers on a bolster, it can readily be appreciated that the individual wiring associated with SAM's according to this invention use but a small fraction of the wire needed for traditional SAM wiring. It should be understood that though a single serial path is needed for SAM's of some embodiments of this invention, organization of SAM's into plural concatenations is contemplated. For example, organs often being organized as divisions associated with a particular clavier, a concatenation per division might be desired.

Figures 12A, 12B, 12C:
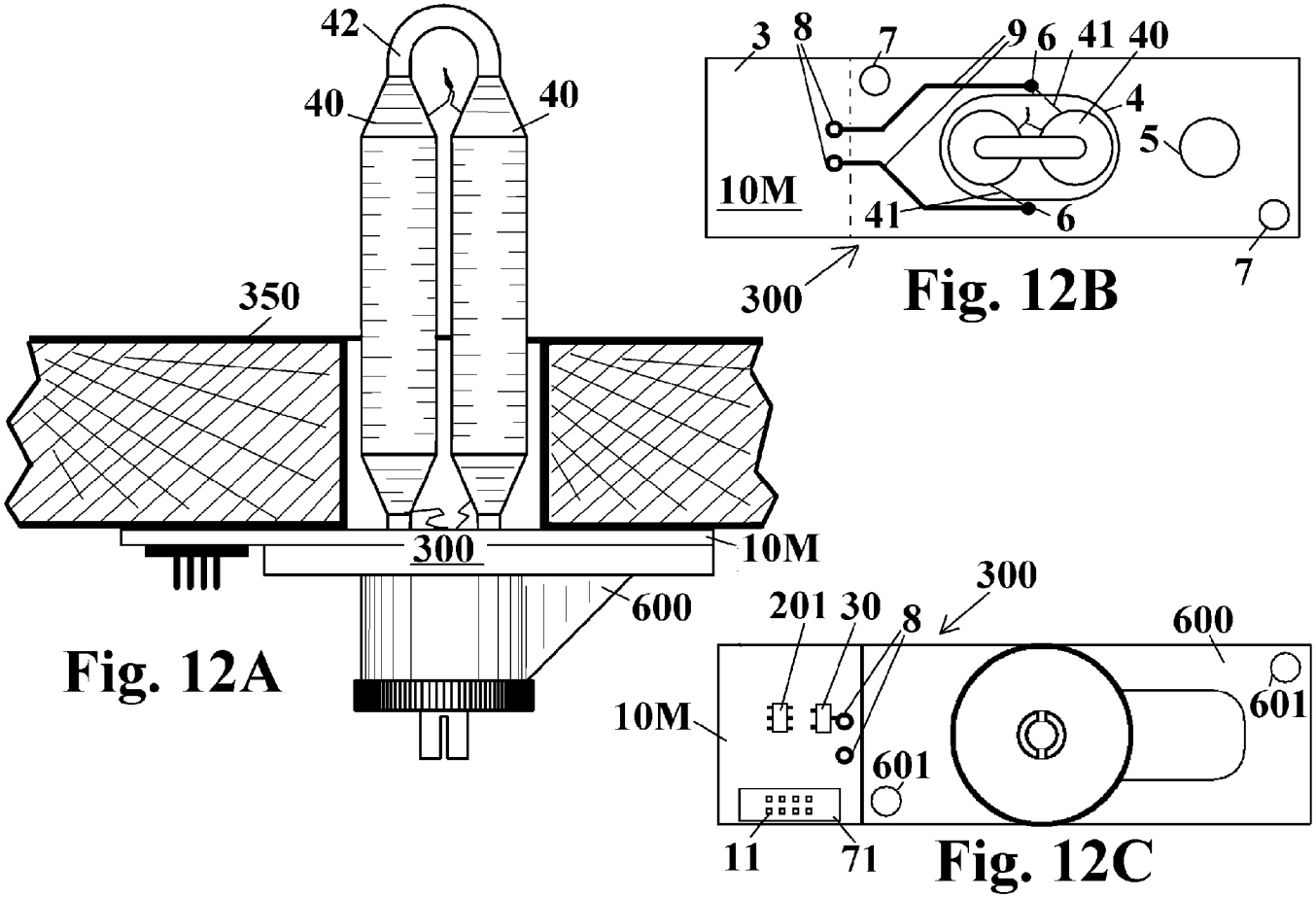
FIG. 12A shows a preferred embodiment of an integrated pipe action-magnet according to the present invention, installed in an organ wind-chest.
FIG. 12B shows a top-view of the integrated pipe action-magnet of FIG. 12A, without the wind-chest.
FIG. 12C shows a bottom-view of the integrated pipe action-magnet of FIG. 12A.

FIG. 12A depicts an integrated pipe action-magnet 300, according to the present invention in top-view, comprising an action-magnet driver 10M, also according to the present invention. Action-magnet 300 also comprises a pipe action-magnet 600 of conventional character. Shown here is an indirect pipe action-magnet 600 comprising a coil 40 wound on a bent iron rod 42, all here illustrated installed in a wind-chest 350. Driver 10M may be attached with an adhesive to action-magnet 600 and, upon mounting, may further be secured by screws passing though mating mounting apertures into wind-chest 350.

FIG. 12B shows integrated action-magnet 300 without wind-chest 350. Driver 10M shown is built on a conventional printed circuit board 3 penetrated through by mounting apertures 7, an aperture 4 through which coils 40 may be passed, an opening 5 through which wind from a pneumatic actuator may pass responsive to operation of coil 40, and plated-though vias 8 to electrically connect the circuit of coil 40 to the other side of circuit board 3. Pads 6 are shown to provide for terminating coil 40 leads 41. Circuit traces 9 electrically connect pads 6 to holes 8.

FIG. 12C shows action-magnet 300 in bottom-view. Action magnet 600 is penetrated through by mounting apertures 601 and lies beneath a right-hand portion of circuit board 3. To its left are shown plated-though vias 8, one of which may connect to switch 30. A connector 71, typically a header intended to mate with an IDC receptacle pressed onto a ribbon-cable, is shown. A pin 11 corresponds to terminal 11 of FIG. 5, and typifies other such pins needed for driver 10 of both FIG. 5 and 10M this figure. Also shown is a micro-controller 201 that emulates the functions of shift-cell 20 and latch-cell 21 of FIG. 5. The Microchip Technology PIC10F200 exemplifies a suitable micro-controller for this action-magnet.

Just as micro-controller 200 of FIG. 8 emulates the discrete logic of FIG. 7, micro-controller 201 of this figure emulates the discrete logic of FIG. 5. Using micro-controller 201 facilitates merging of instruction functions into a single common conductor just as with micro-controller 200 of FIG. 8. Limited space around indirect pipe-action-magnets makes small connectors advantageous, thus minimizing wires may be helpful.

Routines needed to operate this integral action-magnet may be a subset of those explained for FIGS. 9A and 9B. Temporal instruction parsing may be as explained for FIG. 9A, save that a load path may be omitted. The clock, latch, and reset paths may be as explained for FIG. 9B, save that 100 mS time start and 100 mS tests may be omitted.

As with SAM 110M of FIG. 8, address recognition to facilitate a single-wire protocols may, according to this invention, be implemented within micro-controller 201 as with SAM 110M of FIG. 8. Such protocols are not limited a one-wire protocol as cited above. For example, an integrated action-magnet or driver contemplated by this invention may be programmed to respond to MIDI messages.

It is understood that the invention is not limited to the disclosed embodiments, but on the contrary, is intended to cover various modifications and equivalent arrangements included within the spirit and scope of the appended claims. Without further elaboration, the foregoing will so fully illustrate the invention, that others may by current or future knowledge, readily adapt the same for use under the various conditions of service.

What is claimed is:

1. A stop action-magnet for a musical instrument comprising an electromagnetic coil, further comprising a printed circuit board further comprising, a Metal Oxide Field-Effect Transistor (MOSFET), a Bipolar Junction Transistor (BJT), an Insulated Gate Bipolar Transistor (IGBT), or a thyristor.

2. A stop action-magnet for a musical instrument according to claim 1 wherein, the printed circuit board further comprises decoding circuitry to drive the MOSFET, BJT, IGBT, or thyristor responsive to instructions emanating from controlling components of the musical instrument.

3. A stop action-magnet for a musical instrument according to claim 2 wherein, the decoding circuitry is responsive to traditional Stop Action-Magnet (SAM) ON and OFF coil signals emanating from controlling components of the musical instrument.

4. A stop action-magnet for a musical instrument according to claim 2 wherein, the decoding circuitry is responsive to digital data emanating from controlling components of the musical instrument.

5. A stop action-magnet for a musical instrument according to claim 4 wherein, the decoding circuitry is responsive to digital data emanating from controlling components of the musical instrument wherein, the digital data comprises embedded address data.

6. A stop action-magnet for a musical instrument according to claim 4 wherein, the decoding circuitry is responsive to Musical Instrument Digital Interface (MIDI) signals emanating from controlling components of the musical instrument.

7. A stop action-magnet for a musical instrument according to claim 1, the printed circuit board comprises signaling circuitry for electrical communication between musical instrument components.

8. A stop action-magnet for a musical instrument according to claim 7 wherein, the signaling circuitry generates signals for stop action-magnet concatenation.

9. A stop action-magnet for a musical instrument according to claim 7 wherein, the signaling circuitry generates signals to transmit data responsive to SAM position to controlling components of the musical instrument.

* * * * *